US005646975A

United States Patent [19]

Homer

[11] Patent Number: 5,646,975

[45] Date of Patent: Jul. 8, 1997

[54] COUNTING AND MARKING DEVICE

[76] Inventor: John W. Homer, 108 Forest La., Cheshire, Conn. 06410

[21] Appl. No.: 625,869

[22] Filed: Apr. 1, 1996

Related U.S. Application Data

[63] Continuation-in-part of Ser. No. 494,805, Jun. 26, 1995, Pat. No. 5,506,876.

[51] Int. Cl.[6] ..... G07C 3/00

[52] U.S. Cl. ..... 377/15

[58] Field of Search ..... 377/15

[56] References Cited

U.S. PATENT DOCUMENTS 4,726,044 2/1988 Perna et al. ..... 377/15

FOREIGN PATENT DOCUMENTS 0087985 7/1980 Japan ..... 377/15

0058590 4/1984 Japan ..... 377/15

*Primary Examiner*—Margaret Rose Wambach

*Attorney, Agent, or Firm*—Norman B. Rainer

[57] ABSTRACT

A device for reliably counting and simultaneously marking objects includes an elongated housing, a container of marking fluid disposed within the housing, a fluid release mechanism associated with the container, and an axially moveable hollow spacer adapted to contact an object to be counted and marked and through which marking fluid is accurately directed onto the object. The spacer is rearwardly displaced by contact with the object, such displacement being detected by an electrical switch. An electronic controller, when activated by the switch, causes the release mechanism to emit a pulse of marking fluid, and at the same time registers an accumulating count.

8 Claims, 2 Drawing Sheets

COUNTING AND MARKING DEVICE

RELATED APPLICATIONS

This application is a continuation-in-part of U.S. patent application Ser. No. 08/494,805, filed Jun. 26, 1995, U.S. Pat. No. 5,506,876.

BACKGROUND OF THE INVENTION

1. Field of the Invention

This invention concerns the counting of items and simultaneous marking of said items during counting, and further relates to apparatus for accurately achieving said simultaneous counting and marking.

2. Description of the Prior Art

In the course of conducting business activities, it is often necessary to take an inventory of items in storage as on shelves or in bins, racks or other storage systems. The counting of items of similar or identical appearance can be a tedious chore and subject to considerable error, particularly if the items are subject to movement in the course of the counting operation.

To enhance the accuracy of counting, one technique involves the marking of an item at the instant that it is being counted. Devices for the simultaneous marking and counting of items have earlier been disclosed, as for example in the following U.S. Patents:

U.S. Pat. No. 4,993,050 to Carpenteri, et. al., discloses a counter/marker apparatus comprising a head assembly counter mechanism and attached first elongated sleeve. A second sleeve, portioned within said first sleeve for axially slidable reciprocal motion therein, is adapted to carry a marking pen. Relative movement between said sleeves causes activation of a switch which registers one unit of count upon said counter mechanism. A restoring spring urges the tip of the marking pen forwardly.

Although the Carpenteri, et. al., apparatus is based upon sound general concepts, one of its shortcomings is that, as indicated at column 2, lines 50–53, the tip of the marking pen must be displaced rearwardly by at least ⅛ inch to activate the switch. The problem is that, if the pen is not displaced rearwardly by at least ⅛ inch, a mark will be made on an item but no count will be made. It is also possible that, if the travel of the pen is not a pure reciprocal harmonic motion, as a result of a pause or axially transverse wiggle, more than one count may be registered with a single marking.

U.S. Pat. No. 4,726,044 to Perna, et. al., discloses a counter/marker device in the form of a ball point pen having a movable ball point that is passed upwardly in the direction of the housing of the pen when a mark is made. Such upward movement closes a switch which activates an electronic counter. A second switch, activated by gravity, resets the counter for counting the next mark. The Perna, et.al., device will only function in marking substrates that are downwardly disposed. Also, there is no assurance that the counter is activated even though a mark has been made.

U.S. Pat. No. 4,048,478 to Miwa, et. al., concerns a pen-shaped marking apparatus with electronic counter. The apparatus utilizes a single push button type of switch to activate the counter.

U.S. Pat. 4,295,038 to Kreinbrink, et. al., discloses a pen-shaped marker connected by an electrical conductor to an otherwise separate counter device. As in the foregoing devices, there is no fail-safe provision to assure that, for each mark, there is a single count.

U.S. Pat. 4,532,642 to Morris, et.al., discloses a counting stamper apparatus. A switch, mounted in the handle of the apparatus, is contacted by the upwardly directed stamping element to activate an electronic counting circuit.

It is accordingly an object of the present invention to provide a marking and counting device which will infallibly register a single count for each mark.

It is a further object of this invention to provide a device as in the foregoing object which can be employed in any attitude of use.

It is another object of the present invention to provide a device of the aforesaid nature which is of compact construction and easy to use.

These objects and other objects and advantages of the invention will be apparent from the following description.

SUMMARY OF THE INVENTION

The above and other beneficial objects and advantages are accomplished in accordance with the present invention by a device for counting and marking objects, said device comprising:

a) a housing elongated upon a center axis and having forward and rearward extremities, b) a reservoir container for the confinement of a marking fluid, said container being disposed within said housing and having a closed rear extremity and a front extremity located adjacent the forward extremity of said housing, c) delivery means associated with the front extremity of said container for controllably releasing marking fluid from said container, d) axially moveable hollow spacer means forwardly associated with said delivery means and through which said marking fluid is accurately directed onto said object, e) a restoring spring which serves to urge said spacer means forwardly, f) electronic means located within said housing for counting, and controlling said delivery means, and, g) switch means for activating said electronic means, said switch means being in an off condition while said spacer means is at a forward-most position under the urging of said restoring spring, and is in an on condition when said spacer means is forced rearwardly against the urging of said restoring spring, whereby the on condition of said switch causes: 1) said delivery means to release a controlled amount of marking fluid which is directed by said spacer means onto an object which said spacer means is pressed against, and 2) said electronic means to register a count.

The housing also holds batteries for energizing the electronic means. Display means in the form of digital L.C.D. units are mounted upon the exterior surface of the housing. Such display means may show not only the count number but other information derivable from a small electronic computer.

The device may further be provided with a forwardly projected light source to aid in viewing the objects which are being counted, and an audio/visual mechanism which will produce a sound and light signal each time an object is marked and properly counted.

A calculator may be added to the device to aid in various calculating functions that may be present in a counting environment. The calculator may also have a precount (count-up or count-down) function that would allow a specific number to be inputted into the calculator as the counting/marking device progresses near the predetermined count, an audio/visual signal would be emitted to alert the individual that the predetermined number has been reached.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
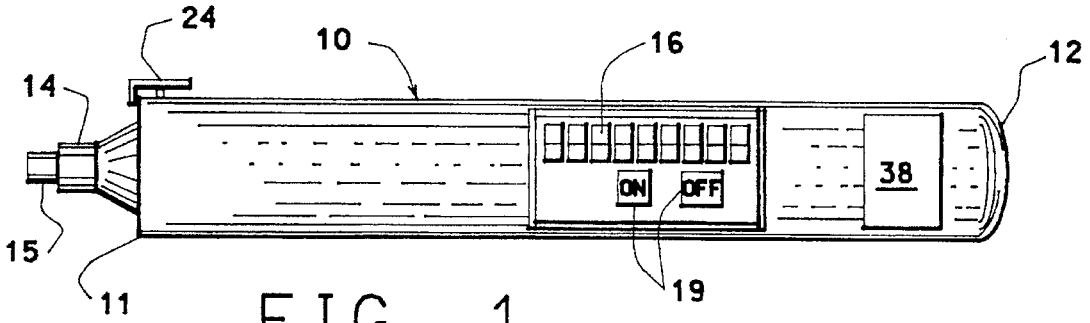
FIG. 1 is a side view of an embodiment of the device of the present invention.
Figure 2:
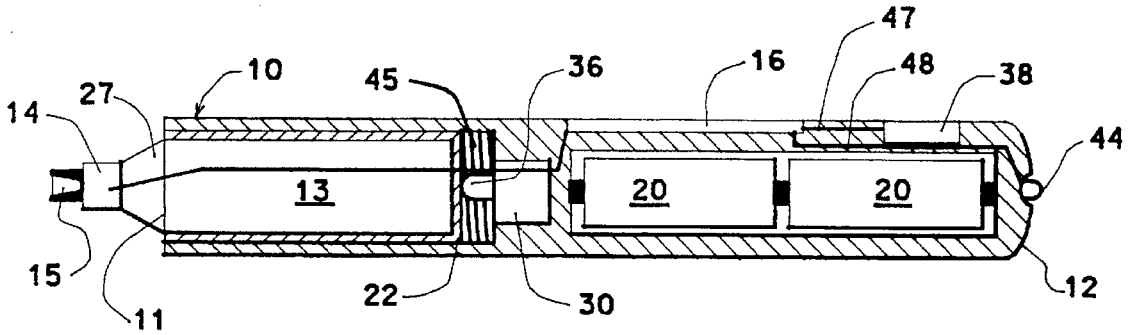
FIG. 2 is a sectional view taken in the direction of the arrows upon the line 2—2 of FIG. 1.
Figure 3:
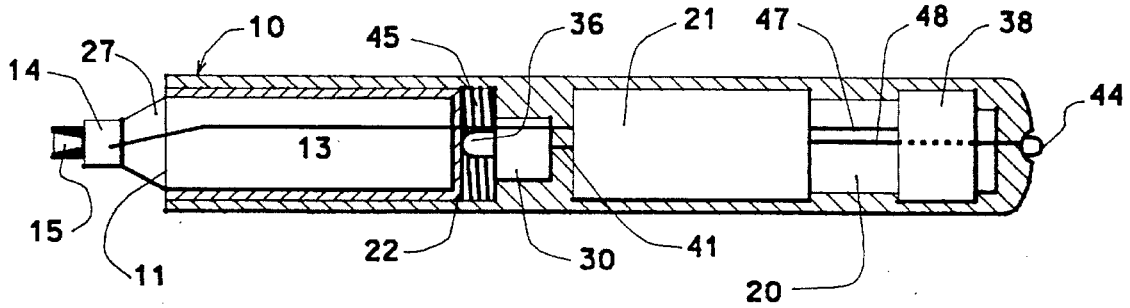
FIG. 3 is a sectional view taken in the direction of the arrows upon the line 3—3 of FIG. 2.
Figure 4A:
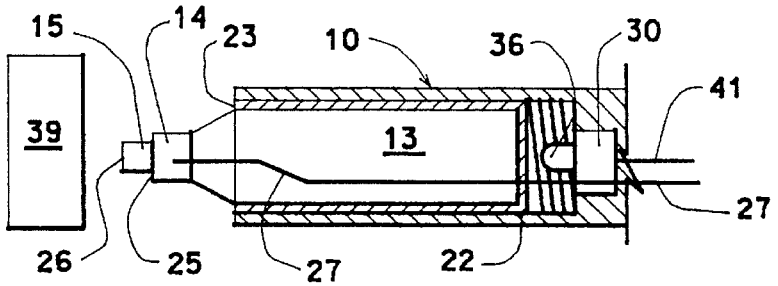
FIG. 4*a* is an enlarged fragmentary schematic view of the embodiment of FIG. 2 illustrating the juxtaposition of components prior to use in a counting and marking step.
Figure 4B:
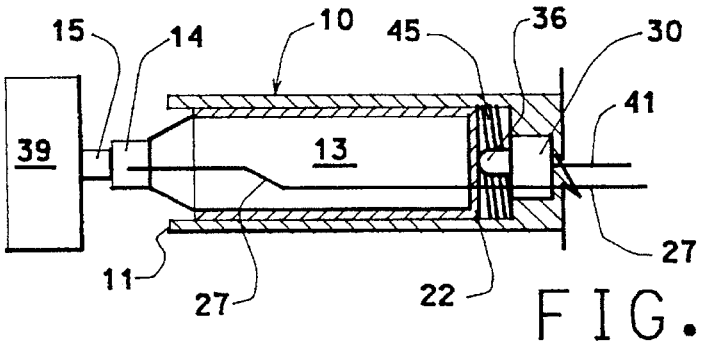
FIG. 4*b* is a view similar to FIG. 4*a* showing the status of components upon initiation of a counting and marking step.

Referring to FIGS. 1–3, an embodiment of the device of the present invention is shown comprised of elongated housing 10 having forward and rearward extremities 11 and 12, respectively, reservoir container 13 slideably disposed within said housing, delivery means 14 associated with said container, and spacer means 15 forwardly attached to said delivery means.

Positioned upon the exterior surface of housing 10 are liquid crystal diode display window 16 and on/off buttons 19. A removable panel is associated with the housing to facilitate insertion of batteries 20 into housing 10. Noise-generating means 38 which may be in the form of a horn, buzzer or bell, and light signaling means 44 may be associated with rearward extremity 12.

Electronic means 21 for counting, control and computational functions is located within said housing beneath said display window 16. The electronic means is of known construction, and may typically be the same electronic means as disclosed in the aforesaid U.S. Pat. Nos. 4,993,050; 4,726,044; 4,048,478; and 4,295,038.

Housing 10 and container 13 may be of metal or plastic construction. Said container serves as a confining reservoir for a marking fluid such as an ink or paint, and is elongated upon a center axis between a closed rear extremity 22, and front extremity 23 located adjacent forward extremity 11 of said housing. A pressurized gas or a highly volatile propellant fluid may be confined within said container to expedite expulsion of said marking fluid. A spring-urged retaining clamp 24 may be associated with forward extremity 11 to limit forward travel of said container within said housing, yet permitting removal and replacement of said container.

Delivery means 14, associated with the front extremity of said container and in communication with the marking fluid confined within said container, may be adapted from generic ink jet head, or bubble jet head technology currently found in commercially available printers, fax machines and other printing and/or marking devices, or other equivalent means for controlling the release of said marking fluid. The delivery means 14 must be activatable by an electrical impulse that can be supplied by the batteries 20.

Spacer means 15 is a hollow shroud-like nozzle-shaped conduit having a proximal extremity 25 associated with delivery means 14, and a distal extremity 26 adapted to contact an object 39 which is to be marked and simultaneously counted by the device of this invention.

A restoring spring 45 serves to urge said spacer means 15 forwardly. In the embodiment of FIGS. 1–4*b*, said spring is a coil spring interposed between rear extremity 22 of slidable container 13 and said housing. In said embodiment, said spacer means 15 is urged forwardly because of its fixed attachment to delivery means 14 which in turn, is affixed to said container 13. Accordingly, when, in said embodiment the distal extremity 26 of spacer means 15 is pressed against object 39, the entire fixed assembly comprised of spacer means 15, delivery means 14 and container 13 slides rearwardly within said housing against the urging of spring 45.

Figure 5A:
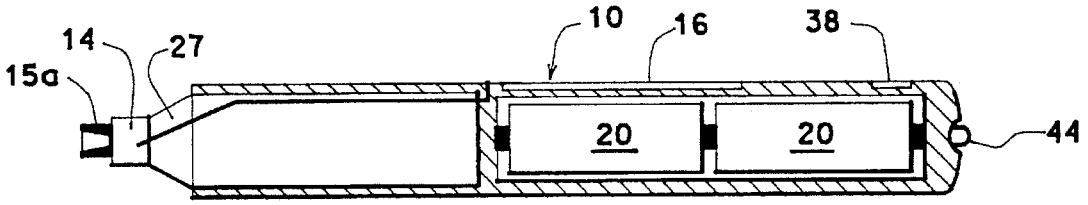
FIG. 5*a* is a sectional side view similar to FIG. 2 showing an alternative embodiment of the device of this invention.
Figure 5B:
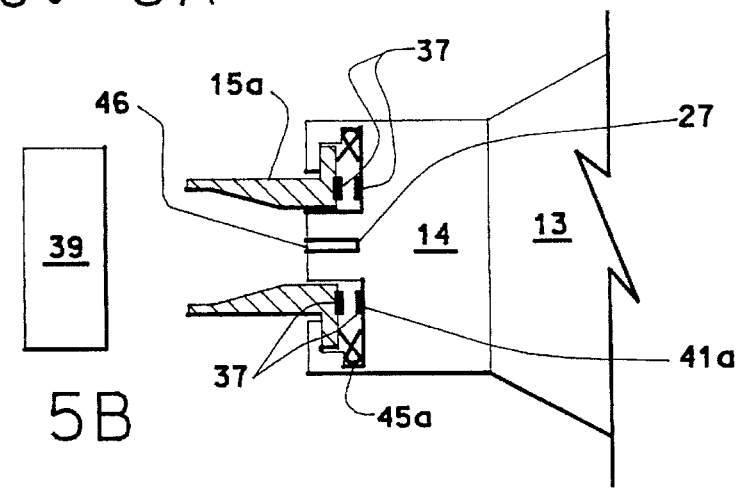
FIG. 5*b* is an enlarged fragmentary schematic view of the embodiment of FIG. 5*a* illustrating the juxtaposition of components prior to use in a counting and marking step.
Figure 5C:
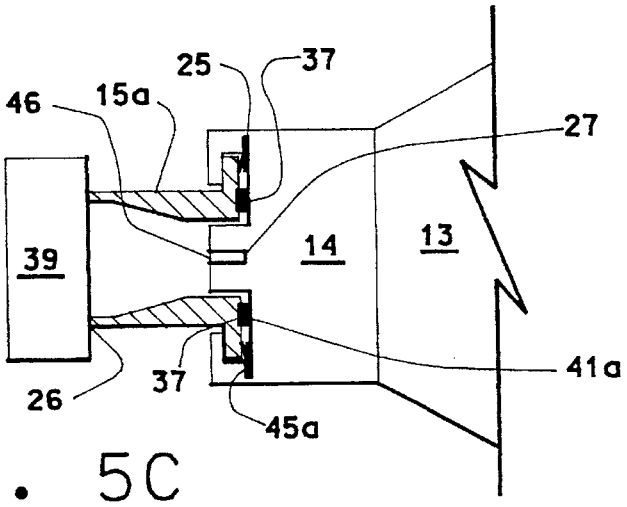
FIG. 5*c* is a view similar to FIG. 5*b* showing the status of components upon initiation of a counting and marking step.

In the alternative embodiment illustrated in FIGS. 5*a*–*c*, container 13 and attached delivery means 14 are stationary within said housing, and said spacer means 15*a* is axially movable with respect to said delivery means 14. In said alternative embodiment, restoring spring 45*a* is interposed between the proximal extremity 25 of said spacer means, and now stationary delivery means 14. Although restoring spring 45 is shown as a coil said spring and spring 45*a* may have other forms such as leaf or folded springs or Bellville-type washers.

On/off switch means in the form of switch 30 is disposed rearwardly of container 13 in the embodiment of FIGS. 1–4*b*. In said embodiment, a plunger 36, axially displaceable by slidable container 13, causes switch 30 to close to an electrically off state when said container is in its forward position, and in an electrically on state when said container is in its rearward-most position.

In the alternative embodiment of the device exemplified in FIGS. 5*a*–*c*, said switch means is in the form of opposed axially aligned contacts 37. In said alternative embodiment, the switch means is in an electrically off state when said separately moveable spacer means 15*a* is in its forward position, and is in an electrically on state when spacer means 15*a* is in its rearward-most position. Switching means other than the exemplified contact-type switches may be employed, other suitable position control means include proximity devices, electrostatic, and capacitative and optical sensors. Electrical conductor wire 41 or 41*a* establishes an electrical circuit between said switch means 30 or 37, electronic means 21, and batteries 20. A control wire 27 extends from said electrical circuit to delivery means 14 to carry an electrical impulse for activating said delivery means. Although exemplified as being battery operated, other power sources such as conventional AC current may power the apparatus.

In the operation of the device of the present invention, as illustrated in FIGS. 4*a*, 4*b*, 5*b* and 5*c*, when the distal extremity 26 of spacer means 15 or 15*a* is pressed against an object 39 against the urging of said restoring spring 45 or 45*a*, said switch means is placed in its electrically on state. Such action causes electronic means 21 to: a) send a signal through control wire 27 to delivery means 14, thereby releasing a pulse of marking fluid through nozzle 46 onto the object that is being marked and counted, b) simultaneously send a signal through lead wire 47, causing noise generating means 38 to emit a sound, c) concomitantly send a signal through lead wire 48 to cause the light signaling means 44 to flicker, and d) concurrently register a single count in display window 16. Accordingly, by virtue of the aforesaid arrangement of components, the device of this invention infallibly produces one mark for each count.

While particular examples of the present invention have been shown and described, it is apparent that changes and modifications may be made therein without departing from the invention in its broadest aspects. The aim of the appended claims, therefore is to cover all such changes and modifications as fall within the true spirit and scope of the invention.

Having thus described my invention, what is claimed is:

1. A device for counting and marking objects, said device comprising:

a) a housing elongated upon a center axis and having forward and rearward extremities, b) a reservoir container for the confinement of a marking fluid, said container being disposed within said housing and having a closed rear extremity and a front extremity located adjacent the forward extremity of said housing, c) delivery means associated with the front extremity of said container for releasing marking fluid from said container controllably by way of an electrical pulse, d) axially moveable hollow spacer means forwardly associated with said delivery means and through which said marking fluid is accurately directed onto said object, e) a restoring spring which serves to urge said spacer means forwardly, f) electronic means located within said housing for counting, and controlling said delivery means, and, g) switch means for activating said electronic means, said switch means being in an off condition while said spacer means is at a forward-most position under the urging of said restoring spring, and is in an on condition when said spacer means is forced rearwardly against the urging of said restoring spring, whereby the on condition of said switch causes: 1) an electrical pulse to be routed to said delivery means to release a controlled amount of marking fluid which is directed by said spacer means onto an object which said spacer means is pressed against, and 2) said electronic means to register a count.

2. The device of claim 1 wherein said restoring spring is a coil spring.

3. The device of claim 1 further comprising batteries which are confined within said housing.

4. The device of claim 1 further comprising light signalling means.

5. The device of claim 1 further comprising noise generating means.

6. The device of claim 1 further comprising a liquid crystal diode display window.

7. The device of claim 1 wherein said reservoir container is slideably disposed within said housing.

8. The device of claim 1 wherein said switch means is in the form of opposed aligned contacts.

* * * * *